US012102128B2

(12) United States Patent
Zhang et al.

(10) Patent No.: US 12,102,128 B2
(45) Date of Patent: Oct. 1, 2024

(54) CIGARETTE HEATER AND ELECTRIC HEATING SMOKING APPARATUS

(71) Applicant: Shenzhen First Union Technology Co., Ltd., Shenzhen (CN)

(72) Inventors: Yunkai Zhang, Shenzhen (CN); Baoling Lei, Shenzhen (CN); Shuhui Tang, Shenzhen (CN); Ruilong Hu, Shenzhen (CN); Zhongli Xu, Shenzhen (CN); Yonghai Li, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 585 days.

(21) Appl. No.: 17/425,886

(22) PCT Filed: Jan. 19, 2020

(86) PCT No.: PCT/CN2020/072996
§ 371 (c)(1),
(2) Date: Jul. 26, 2021

(87) PCT Pub. No.: WO2020/151618
PCT Pub. Date: Jul. 30, 2020

(65) Prior Publication Data

US 2022/0160040 A1 May 26, 2022

(30) Foreign Application Priority Data

Jan. 26, 2019 (CN) ..... 201920135571.4
Jan. 26, 2019 (CN) ..... 201920135572.9

(51) Int. Cl.
*A24F 40/465* (2020.01)
*A24F 40/20* (2020.01)
*A24F 40/42* (2020.01)

(52) U.S. Cl.
CPC ..... *A24F 40/465* (2020.01); *A24F 40/20* (2020.01); *A24F 40/42* (2020.01)

(58) Field of Classification Search
CPC ..... A24F 40/465; A24F 40/20; A24F 40/42
(Continued)

(56) References Cited

U.S. PATENT DOCUMENTS 8,881,737 B2 * 11/2014 Collett ..... A24F 40/30 131/194
2002/0084001 A1 * 7/2002 Iwasaki ..... H01F 1/059 148/306
2015/0181935 A1 7/2015 Lyubomirskiy et al.

FOREIGN PATENT DOCUMENTS

CN 101337175 B * 6/2010
CN 103653257 A 3/2014
(Continued)

*Primary Examiner* — Peter G Leigh
(74) *Attorney, Agent, or Firm* — Proi Intellectual Property US

(57) ABSTRACT

A cigarette heater, comprising a heating assembly and a heat insulation assembly used for insulating the heating assembly; the heating assembly comprises a longitudinal heating cavity used for accommodating a cigarette and a heating body used for heating the cigarette; the heat insulation assembly comprises an anisotropic material layer sleeved outside the heating assembly, the thermal conductivity coefficient of the anisotropic material layer in the radial direction being lower than the thermal conductivity coefficient thereof in the axial direction, being used for reducing the thermal conduction of the heat in the heating cavity along the radial direction toward the periphery. By means of arranging the anisotropic material layer outside the heating assembly, the present cigarette heater isolates the heat transfer in the radial direction and also converts the direction of conduction to a dispersed transfer toward the axial direction, reducing the radially outward heat transfer.

19 Claims, 5 Drawing Sheets

(58) Field of Classification Search
USPC ..... 131/329
See application file for complete search history.

(56) References Cited

FOREIGN PATENT DOCUMENTS

| | | | | |
|---|---|---|---|---|
| CN | 102676010 | B | * | 7/2014 |
| CN | 204481641 | U | * | 7/2015 |
| CN | 103653257 | B | * | 12/2015 |
| CN | 106263039 | A | | 1/2017 |
| CN | 207040896 | U | * | 2/2018 |
| CN | 108433191 | A | | 8/2018 |
| CN | 208259014 | | * | 12/2018 |
| CN | 208259014 | U | | 12/2018 |
| CN | 209768994 | U | | 12/2019 |
| CN | 209788481 | U | | 12/2019 |
| JP | 2004254431 | A | * | 9/2004 |
| WO | 2019017654 | A | | 1/2019 |
| WO | 2019053598 | A | | 3/2019 |

* cited by examiner

CIGARETTE HEATER AND ELECTRIC HEATING SMOKING APPARATUS

TECHNICAL FIELD

The present disclosure relates to the technical field of smoking sets, and in particular to a cigarette heater and an electric heating smoking apparatus.

BACKGROUND

Low-temperature tobacco-heating type electronic cigarette (also called low-temperature heating electronic cigarette) is a kind of product which electrically heats a tobacco product (for example, cigarette, tobacco core, etc.) placed in a heating assembly by a smoker, at a lower temperature than the combustion temperature of the tobacco product, so that the tobacco product generates an aerosol for the smoker to inhale. With the low-temperature heating electronic cigarette, the tobacco product generates an aerosol through being heated, instead of being combusted, which avoids the fact that lots of harmful substances generated during the combustion of the tobacco product are inhaled by a user; therefore, the low-temperature heating electronic cigarette is gradually prompted and accepted as a substitute to the traditional cigarette.

This type of low-temperature heating electronic cigarette mainly includes two function modules, which are a tubular heating assembly configured for heating a cigarette and a power unit configured for supplying power to the heating assembly respectively. When the low-temperature heating electronic cigarette is used, the heating assembly needs to generate a high temperature to heat a cigarette, however, the external heat of the heating assembly dissipates quickly and as a result the internal heat is reduced; consequently, on one hand, the dissipation of heat towards outside will make the user's hands feel hot, moreover, the shell and the circuit board will generate heat to cause overheating damages and failures; on the other hand, the internal heat of the heating assembly is not continuously insufficient, which is difficult for the cigarette to generate sufficient smoke, thus the experience of inhalation of the smoker is poor.

Therefore, in view of the above problems, generally a heat insulation structure configured for insulating a heating assembly is disposed inside the low-temperature heating electronic cigarette, for example, the technical scheme of vacuum-insulated evaporator employed in a Chinese patent application number 201510856387.5 to Rufeng Wei, in which an insulation tube is sleeved outside a heating element, the insulation tube has a tube wall including at least two layers of glass, and a vacuum cavity is defined between the adjacent layers of glass. For another example, an insulation device applied to an electronic cigarette disclosed in a similar Chinese patent application number 201810461864.1, which includes a vacuum tube sleeved outside a ceramic heating tube, wherein an aerogel tube is sleeved outside the vacuum tube and an insulation sleeve is further disposed outside the aerogel tube; through the combination of the vacuum, aerogel and insulation sleeve, the insulation effect is improved.

Although the above vacuum insulation modes are simple and convenient in implementations, the metallic vacuum tube sleeved outside the electromagnetic heating assembly will impact the energy efficiency of electromagnetic heating and cause the temperature of the heating body fail to rise up, meanwhile, the metallic vacuum tube itself will generate heat when located in the electromagnetic field, which greatly reduces the insulation effect. Furthermore, after these multilayer structures are assembled with the heating element, the air convection on the surface of each tube reduces the heat insulation effect.

SUMMARY

In order to solve the problems in existing technologies of electronic cigarettes that the heat insulation effect is poor and the energy efficiency of the heating element is impacted, the present disclosure provides a cigarette heater having an excellent insulation effect.

The cigarette heater in the present disclosure includes a heating assembly and a heat insulation assembly configured for insulating the heating assembly, the heating assembly including an elongated heating cavity configured for accommodating a cigarette and a heating body configured for heating the cigarette; wherein the cigarette heater is characterized in that: the heat insulation assembly includes an anisotropic material layer sleeved outside the heating assembly, the anisotropic material layer having a lower thermal conductivity coefficient in the radial direction than in the axial direction, and the anisotropic material layer configured for reducing conduction of heat from inside the heating cavity towards periphery of the heating cavity along the radial direction.

The thermal conductivity coefficient of the anisotropic material layer in the axial direction is 30 times or more than that in the radial direction.

The thermal conductivity coefficient of the anisotropic material layer in the axial direction is 30-100 times of that in the radial direction.

Preferably, the heat insulation assembly further includes an insulation tube disposed between the heating assembly and the anisotropic material layer; the insulation tube includes an inner tube body and an outer tube body opposite each other along the radial direction, wherein a spacing is defined between the inner tube body and the outer tube body to form a first insulation cavity; the first insulation cavity is filled with a first powder insulation material; the anisotropic material layer is disposed on the outer surface of the outer tube body in an overlapping manner along the radial direction.

Preferably, the first powder insulation material includes at least one of aerogel powder, diatomite powder and zirconia powder.

Preferably, the first powder insulation material has a particle diameter of 500-1000 μm.

Preferably, the insulation tube further includes a second insulation cavity defined outside the anisotropic material layer in an overlapping manner along the radial direction; the second insulation cavity is filled with a second powder insulation material.

Preferably, the first powder insulation material has a greater particle diameter than that of the second powder insulation material; the second powder insulation material has a particle diameter of 1 to 500-1000 μm.

Preferably, the heat insulation assembly further includes an outer heat shield disposed outside the anisotropic material layer; the outer heat shield is configured for reducing the conduction of the heat from inside the heating cavity towards the periphery of the heating cavity along the radial direction.

Preferably, the outer heat shield has a heat radiation rate lower than 0.3.

Preferably, a spacing is defined between the insulation tube and the heating assembly along the radial direction to form a first air medium layer;

and/or, a spacing is defined between the anisotropic material layer and the outer heat shield along the radial direction to form a second air medium layer.

Preferably, the cigarette heater further includes a hollow outer shell with an open end, an end cover base covering on the open end of the outer shell.

The outer shell and the end cover base are matched to form an accommodating space, in which the heating assembly and the heat insulation assembly are disposed.

The present disclosure also provides a cigarette heater, which includes a heating assembly and a heat insulation assembly configured for insulating the heating assembly, wherein the heating assembly includes a bracket, an electromagnetic coil wound on the bracket, and an induction heating element electromagnetically coupled with the electromagnetic coil, the bracket defining an elongated heating cavity therein, which is configured for accommodating a cigarette.

The heat insulation assembly includes an insulation tube sleeved outside the heating assembly, the insulation tube including an inner tube body and an outer tube body opposite each other along the radial direction, wherein a spacing is defined between the inner tube body and the outer tube body to form a first insulation cavity; the first insulation cavity is filled with a first powder insulation material.

The inner tube body and the outer tube body are made of a non-metallic material.

The heat insulation assembly further includes an anisotropic material layer disposed outside the outer tube body in an overlapping manner along the radial direction; the anisotropic material layer has a lower thermal conductivity coefficient in the radial direction than in the axial direction.

The heat insulation assembly is configured for reducing the conduction of the heat from inside the heating cavity towards periphery of the heating cavity along the radial direction.

The present disclosure further provides a heat insulation device, which includes an inner tube body and an outer tube body disposed coaxially, wherein an inner cavity of the inner tube body forms an accommodating cavity configured for accommodating a heat source; wherein a spacing is defined between the inner tube body and the outer tube body to form a first insulation cavity; the first insulation cavity is filled with a first powder insulation material.

The heat insulation device further includes an anisotropic material layer disposed outside the outer tube body in an overlapping manner along the radial direction.

The present disclosure further provides an electric heating smoking apparatus, which includes a cigarette heating device, and a power device configured for supplying power to the cigarette heating device, wherein the cigarette heating device is any one cigarette heater described above.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

DETAILED DESCRIPTION

For a better understanding of the present disclosure, a detailed description is provided to the present disclosure in conjunction with the drawings and specific embodiments. It is to be noted that when an element is described as "fixed on" another element, it may be directly on this other element, or there might be one or more intermediate elements between them. When one element is described as "connected to" another element, it may be directly connected to this other element, or there might be one or more intermediate elements between them. Terms "upper", "lower", "left", "right," "inner", "outer" and similar expressions used in this description are merely for illustration.

Unless otherwise defined, all technical and scientific terms used in the description have the same meaning as those normally understood by the skill in the technical field of the present disclosure. The terms used in the description of the present disclosure are just for describing specific implementations, not to limit the present disclosure. Terms "and/or" used in the description include any and all combinations of one or more listed items.

The present disclosure provides a cigarette heater, which is applicable to tobacco-heating electronic cigarettes and is configured for heating a specific cigarette. The specific cigarette may be heated at a temperature of about 200 to 320 degrees centigrade to generate an aerosol. The specific cigarette generally includes a cigarette body and a mouthpiece. The structure and the content of the cigarette heater provided in the present disclosure can refer to FIG. 1 to FIG. 2 and the following description.

The cigarette heater is mainly composed of a heating assembly 10, which is configured for heating a cigarette to generate an inhalable aerosol, plus a heat insulation assembly 20. Meanwhile, for the good appearance of the cigarette heater and the requirements of assembling of each part, the cigarette heater further includes a hollow outer shell 30 with an open end, an end cover base 40 covering on the open end of the outer shell 30; the outer shell 30 and the end cover base 40 are matched to form an accommodating space, which is configured for accommodating the heating assembly 10 and the heat insulation assembly 20 mentioned above. A complete cigarette heater is formed after assembling the above parts.

Figure 1:
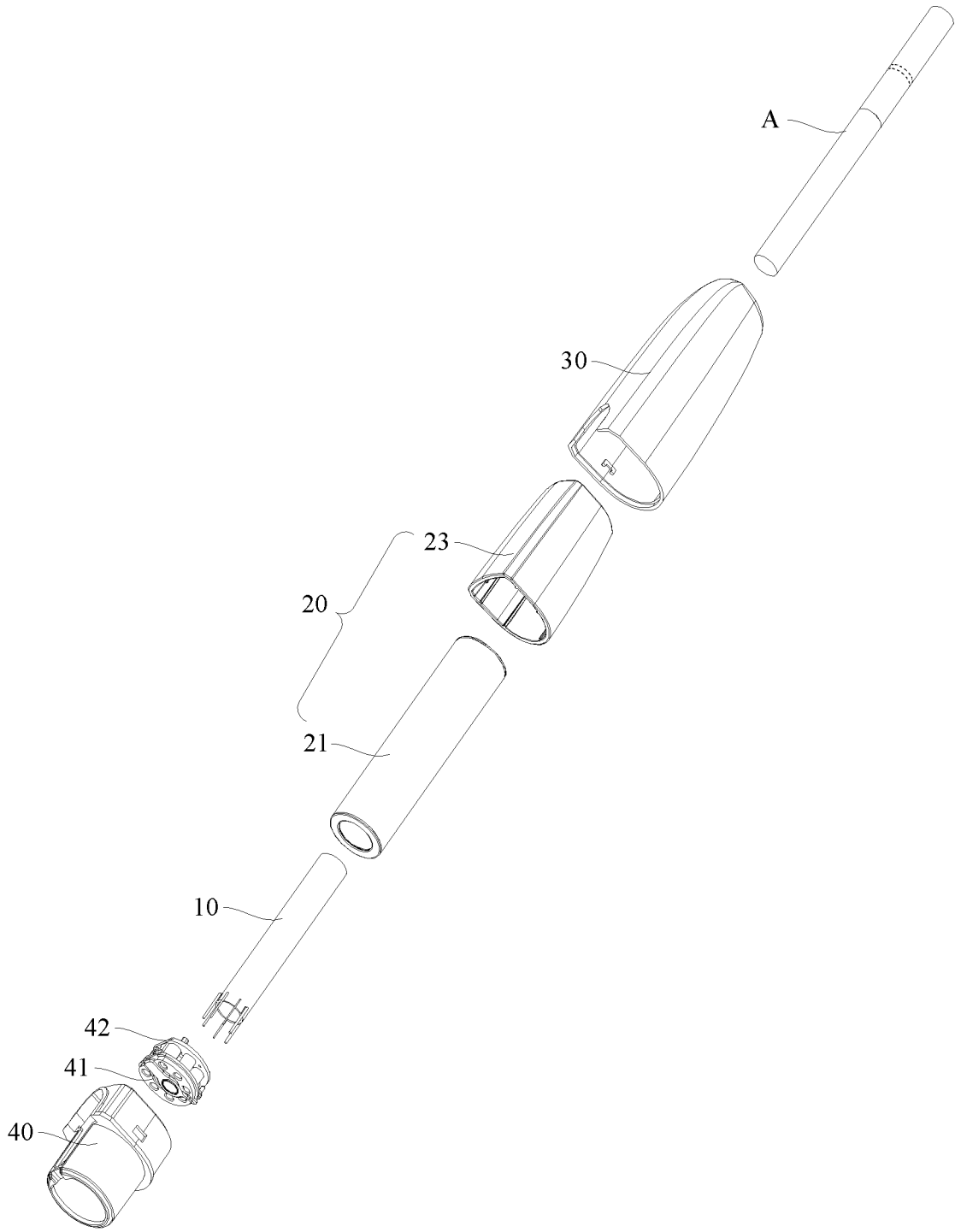
FIG. 1 is an exploded view of a cigarette heater provided in one embodiment before the assembling of each part.
Figure 3:
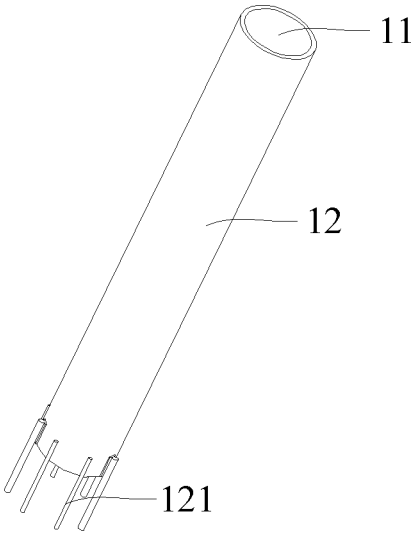
FIG. 3 is a structure view of a heating assembly shown in FIG. 1 and FIG. 2 from another perspective.

Referring to embodiments of FIG. 1 and FIG. 3, the heating assembly 10 includes an elongated heating cavity 11 configured for accommodating a cigarette A and a heating body 12 configured for heating the cigarette A. The heating body 12 and the heating cavity 11 may have adaptive adjustments in formations according to different heating modes of the product. In the embodiments of FIG. 1 and FIG. 3, the heating body 12 is designed to be a cylinder, and an internal space thereof forms the above elongated heating cavity 11 configured for accommodating the cigarette A; meanwhile, for the ease of supplying power to the heating body 12, the heating body 12 is also provided with electrode pins 121, which are consequently connected to positive and negative electrodes of a power unit. During implementation, the heating body 12 itself may be made of an electric-heating material, for example, common resistive materials used for heating in electronic cigarettes, such as nickel-chromium-alloy and stainless steel, or may be formed by printing a heating circuit on an inner wall of a rigid tubular body made of such as ceramic; therefore, after electrified, the heating body 12 is heated and then heats the periphery of the cigarette A accommodated therein to generate an aerosol.

Figure 2:
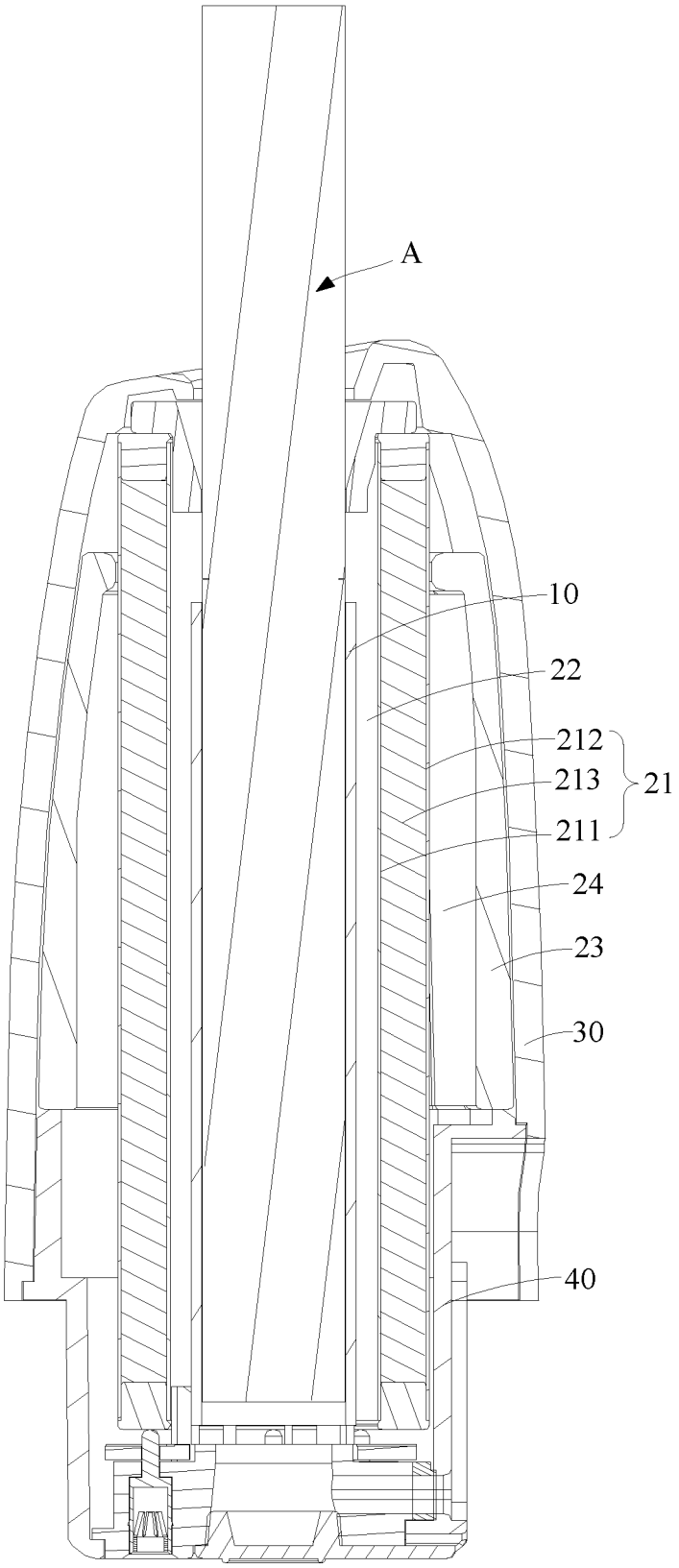
FIG. 2 is a sectional structure view of the cigarette heater shown in FIG. 1 after the assembling of each part.
Figure 4:
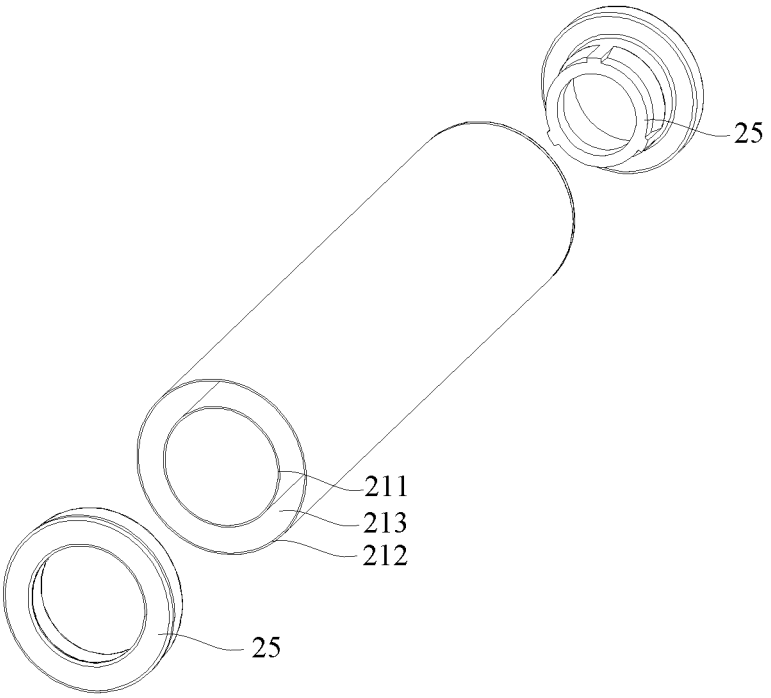
FIG. 4 is a structure view of an insulation tube shown in FIG. 1 and FIG. 2.
Figure 5:
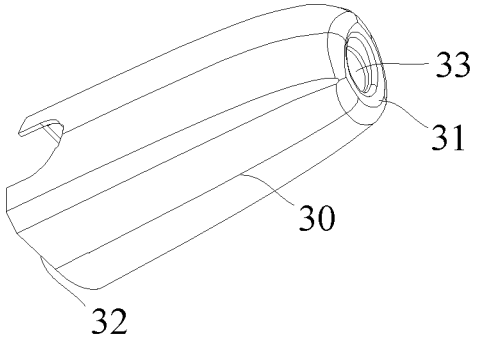
FIG. 5 is a structure view of an outer shell shown in FIG. 1 and FIG. 2.

Corresponding to the structure of the above heating assembly 10, the structure of the heat insulation assembly 20 can refer to FIG. 1, FIG. 2 and FIG. 4. The heat insulation assembly 20 includes an annular insulation tube 21 sleeved outside the heating cavity 11 along the radial direction of the heating cavity 11; the insulation tube 21 includes an inner tube body 211 and an outer tube body 212 opposite each other along the radial direction, wherein a spacing is defined between the inner tube body 211 and the outer tube body 212 to form a first insulation cavity 213 internally; the first insulation cavity 213 is filled with a first powder insulation material; the first powder insulation material may preferably adopt a powder material of low thermal conductivity coefficient, such as aerogel powder, diatomite powder and zirconia powder. By sleeving the insulation tube 21 outside the heating cavity 11, heat may be effectively prevented from dissipating out from the heating cavity 11, thus external temperature can be reduced. According to the requirements of product design and insulation effect, the inner tube body 211 and the outer tube body 212 of the insulation tube 21 may be made from a non-metallic temperature-resistant plastic material, such as polyimide, Teflon, Selenium phosphate gel, polyphenylene sulfide or polysulfone resin, etc., or made of stainless steel, aluminum alloy, etc. The first powder insulation material filled in the first insulation cavity 213 on one hand reduces solid conductivity of heat through particle clearance, physical expansibility, thixotropy, etc., and on the other hand, the apertures' walls on the particle surfaces may be viewed as reflecting surfaces and refracting surfaces for radiation, which well prevent the radiation transfer of heat.

When the above insulation tube 21 is assembled with the heating assembly 10, a spacing is remained between the inner tube body 211 and the heating body 12 along the radial direction, and through maintaining this spacing, a first air medium layer 22 is formed between the inner tube body 211 and the heating body 12; since air itself is a medium of low thermal conductivity, filling the spacing remained between the inner tube body 211 and the heating body 12 with the medium of air can preliminarily prevent the direct transfer of heat. According to the requirements of size and space of the product, the first air medium layer 22 preferably adopts a thickness of 0.5 mm-1.2 mm; the inner tube body 211 and the outer tube body 212 adopt a thickness of 0.1-0.3 mm in implementations. The first insulation cavity 213 adopts a thickness of 1 mm-5 mm, the first powder insulation material filled in the first insulation cavity 213 adopts a particle diameter of 500-1000 μm, and the first powder insulation material filled in the first insulation cavity 213 occupies 70-90% of the volume of the first insulation cavity 213. During implementations, the filled volume percentage may be adjusted to the desired requirement through adjusting the size of particle diameter of the powder particles.

Further, the heat insulation assembly 20 further includes an outer heat shield 23 disposed outside the insulation tube 21 along the radial direction of the insulation tube 21; the outer heat shield 23 itself is made from a temperature-resistant plastic material, such as polyimide, Teflon, Selenium phosphate gel, polyphenylene sulfide or polysulfone resin, etc., or made of an aluminum shell. By making the outer heat shield 23 a supplement to the insulation tube 21, on one hand a multi-layer insulation structure is formed from inside to outside, which performs heat guide and limitation of heat dissipation respectively and thus well isolates the heat inside the heating cavity 11 eventually; on the other hand the outer heat shield 23 and the insulation tube 21 have different heat insulation and conduction mechanisms; the outer heat shield 23 is mainly used as a shield for heat radiation to reduce the radiation of heat towards outside. Based on the effects and requirements of radiation shielding, a material that has a heat radiation rate lower than 0.3 is preferably adopted within the above materials. Meanwhile, based on the requirements of size and preparation of the product, the outer heat shield 23 itself adopts a thickness of 0.5-1.5 mm, and its shape may adaptively change according to the shell shapes of different products.

Meanwhile, in implementations, a spacing may be remained between the outer heat shield 23 and the outer tube body 212 of the insulation tube 21 during installation, such that a second air medium layer 24 is formed between the outer heat shield 23 and the outer tube body 212. The second air medium layer 24 has a similar function to the first air medium layer 22 and can enhance the insulation effect through the property of low thermal conductivity of air.

For the ease of product design and the ease of filling powder insulation materials, the inner tube body 211 and the outer tube body 212 are designed to be separated from each other; two opposite ends of the insulation tube 21 along the axial direction are plugged with plastic plugs 25, which can seal the insulation tube 21 and prevent leakage of powder. When powder is being filled into this structure of insulation tube 21, by means of the opening structure at two ends of the tube, the tube can be vacuumized internally in the condition that the two ends are opened, then the powder insulation material can be sucked into the insulation tube 21 by the internal vacuum, which facilitates the smooth filling in the preparation process.

Further, referring to FIG. 1 to FIG. 5, an outer shell 30 includes a first end 31 and a second end 32 opposite each other along the axial direction of the heating cavity 11; wherein the first end 31 is configured as an insertion end to insert a cigarette and the second end 32 is configured as an opening end matched with the end cover base 40. The first end 30 defines a through hole 33 for a cigarette A to insert into the heating cavity 11 from the outer shell 30; the second end 32 is configured for mounting the end cover base 40, further forming a mounting substrate used for fixing parts such as silicone piece 41, circuit board 42, lead slot and air inlet.

Figure 6:
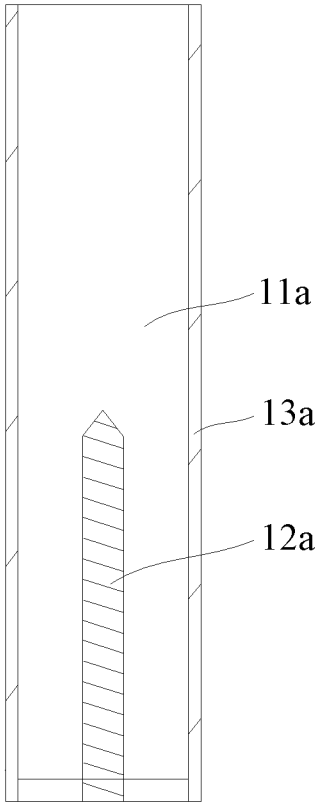
FIG. 6 is a structure view of a heating assembly provided in another embodiment.

Further, based on the variant design of product, the heating assembly 10 and the heat insulation assembly 20 may change accordingly on the basis of the idea of the above function structure design; for example, another heating assembly **10*a* shown in FIG. 6 may be adopted, which includes a cylindrical cigarette accommodation tube 13*a*; an internal space of the cigarette accommodation tube 13*a* forms an elongated heating cavity 11 a configured for accommodating a cigarette; meanwhile, the heating body 12*a* is an elongated metal heating needle disposed along the axial direction of the cigarette accommodation tube 13***a*; when a cigarette is accommodated inside the heating cavity 11*a*, the heating body 12*a* is directly inserted into the cigarette and heats the interior of the cigarette to generate an aerosol. The heat insulation assembly 20 only needs to be sleeved outside the cigarette accommodation tube 13*a* adopting the above structure, to insulate the heat dissipated out by the cigarette accommodation tube 13*a*.

Figure 7:
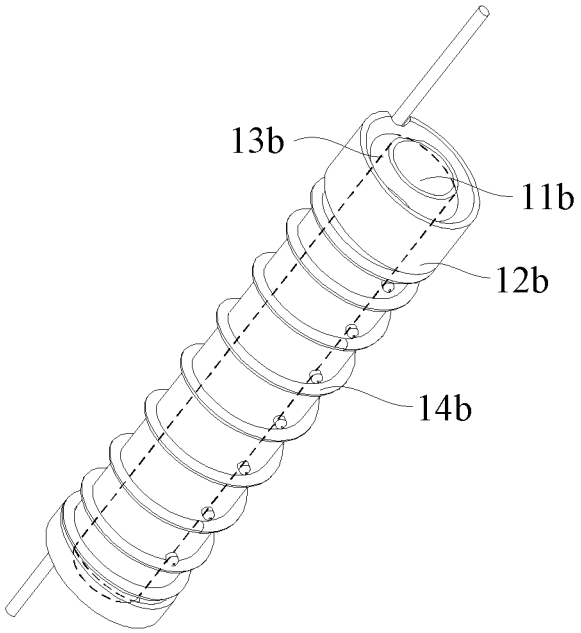
FIG. 7 is a structure view of a heating assembly provided in still another embodiment.

Or, based on implementations, the heating assembly 10 of the cigarette heater may further change, for example, adopting an electromagnetic heating structure shown in FIG. 7, which includes a cigarette accommodation tube 13*b*; an internal space of the cigarette accommodation tube 13*b* forms an elongated heating cavity 11*b* configured for accommodating a cigarette; a tubular bracket 12*b* is sleeved outside the cigarette accommodation tube 13*b*, the tubular bracket 12*b* is configured as a mounting base, on which an electromagnetic coil 14*b* is wound; the cigarette accommodation tube 13*b* itself is made of a metallic material, and is electromagnetically coupled with the electromagnetic coil 14*b* so as to perform induction heating after the electromagnetic coil 14*b* is electrified. Based on the principle of electromagnetic heating, the tubular bracket 12*b* needs to be made of a non-metallic material that is resistant to a working temperature of the inductive heating body 10, so as to avoid the fact that an electromagnetic shielding effect is generated inside the tubular bracket 12*b* if adopting a metallic material and that the cigarette accommodation tube 13*b* cannot perform induction heating. The heat insulation assembly 20 only needs to be sleeved outside the tubular bracket 12*b* adopting the above structure, to insulate the heat dissipated out by the cigarette accommodation tube 13*b*.

Figure 8:
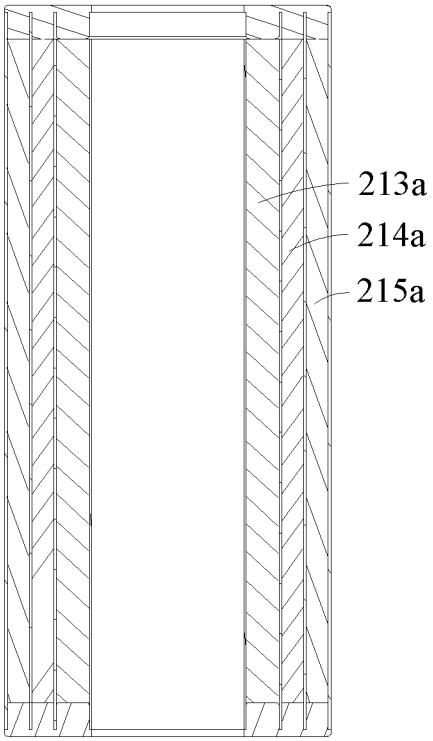
FIG. 8 is a structure view of an insulation tube provided in another embodiment.

Based on the design of further optimization of heat insulation, the structure of the insulation tube 21 in the above heat insulation assembly 20 can refer to FIG. 8 in another embodiment, which can further include an anisotropic material layer 214*a* disposed outside a first insulation cavity 213*a* along the radial direction; an anisotropic material has different physical properties in different dimensional directions, and the structure in the present disclosure utilizes the heat conductivity of the anisotropic material in different dimensional directions; the anisotropic material layer 214*a* is configured to have a lower thermal conductivity coefficient in the radial direction than in the axial direction; when heat is conducted to the anisotropic material layer 214*a* from the heating cavity 10 along the radial direction, the heat will be greatly converted into dispersed conduction along the axial direction; thus, the local conduction of heat will be effectively extended to the surface conduction of larger area, which is conducive to making the temperature conduction more homogenized in the axial and radial directions, reducing local high temperature, and effectively shielding the dissipation of the heat source towards outside. During implementations, the above anisotropic material for heat conduction adopts one or more of graphite materials, such as graphite flake or graphite powder, graphene coating, carbon fiber, titanium dioxide polycrystalline film or polycrystalline silicon. Based on the difference setting of heat conduction in the present disclosure, the thermal conductivity coefficient of the anisotropic material layer 214*a* in the axial direction is 30 times or more than that in the radial direction. Based on the selection of common materials and the effects of implementation, preferably, the thermal conductivity coefficient in the axial direction is 30-100 times of that in the radial direction.

Further, the insulation tube 21 further includes a second insulation cavity 215*a* defined outside the anisotropic material layer 214*a* along the radial direction; the second insulation cavity 215*a* is also filled with a second powder insulation material of low thermal conductivity coefficient, such as aerogel powder, diatomite powder and zirconia powder. The second insulation cavity 215*a* is different from the first insulation cavity 213 in terms of function. The powder material filled in the second insulation cavity 215*a* has a lower grain fineness, which is beneficial to reducing clearance. The second insulation cavity 215*a* is mainly configured for shielding and blocking heat convection. During implementations, the second powder insulation material in the second insulation cavity 215*a* preferably adopts a material that has a particle size of about 1-500 μm and a thermal conductivity coefficient of about 0.02 W/(m.K).

According to the above cigarette heater provided in the present disclosure, a heat insulation assembly with multiple different insulation function structures is disposed outside the heating assembly, so as to isolate the conduction and radiation of heat internally and to block heat convection externally, thereby greatly enhancing the heat insulation effect on the whole, avoiding local high temperature and shielding the transfer of the heat towards outside. Taking the structure shown in FIG. 2 for example, when the insulation tube 21 is made of a stainless steel material, if the first insulation cavity 213 having a thickness of 4 mm is filled by the aerogel powder having an average particle diameter of 500 μm, the surface temperature of the outer shell 30 is about 50 degrees centigrade in a smoking test; however, if the average particle diameter further increases to 800 μm in the first insulation cavity 213, the surface temperature of the outer shell 30 decreases to about 43 degrees centigrade in a smoking test. It is indicated that the insulation effect of a medium in heat conduction can be changed by adjusting the particle size of the filled powder.

The present disclosure further provides an electric heating smoking apparatus including the above cigarette heater, wherein the electric heating smoking apparatus includes a cigarette heating device and a power device configured for supplying power to the cigarette heating device, wherein the cigarette heating device is the cigarette heater described above. Through the heat insulation assembly having multiple layers of different insulation structures, the electric heating smoking apparatus in the present disclosure isolates the conduction and radiation of heat internally and blocks heat convection externally, thereby greatly enhancing the heat insulation effect on the whole, and obtaining a lower temperature on the surface of the electric heating smoking apparatus.

It should be noted that although the description and accompanying drawings of the present disclosure illustrate some preferred embodiments of the present disclosure, the present disclosure may be implemented through many different forms, but not restricted to the embodiments described in the description. These embodiments shall not be construed as additional limitations on the contents of the present disclosure. These embodiments are described for the purpose of providing a more thorough and comprehensive understanding of the disclosed content of the present disclosure. Moreover, various embodiments not listed above formed by the above technical features combining with each other are all intended to be included in the scope of the present disclosure; furthermore, for the ordinary skill in the art, improvements or transformations may be made according to the above description, and these improvements and transformations shall belong to the protection scope of the claims appended below.

What is claimed is:

1. A cigarette heater comprising a heating assembly and a heat insulation assembly configured for insulating the heating assembly, the heating assembly comprising an elongated heating cavity configured for accommodating a cigarette and a heating body configured for heating the cigarette;

wherein the heat insulation assembly comprises an anisotropic material layer sleeved outside the heating assembly, the anisotropic material layer having a lower thermal conductivity coefficient in the radial direction than in the axial direction, and the anisotropic material layer configured for reducing conduction of heat from inside the heating cavity towards periphery of the heating cavity along the radial direction; wherein a first air medium layer is formed between the heat insulation assembly and the heating body.

2. The cigarette heater according to claim 1, wherein the thermal conductivity coefficient of the anisotropic material layer in the axial direction is 30 times or more than that in the radial direction.

3. The cigarette heater according to claim 2, wherein the thermal conductivity coefficient of the anisotropic material layer in the axial direction is 30-100 times of that in the radial direction.

4. The electric heating smoking apparatus, comprising a cigarette heater, and a power device configured for supplying power to the cigarette heater, wherein the cigarette heater is according to claim 3.

5. The electric heating smoking apparatus, comprising a cigarette heater, and a power device configured for supplying power to the cigarette heater, wherein the cigarette heater is according to claim 2.

6. The cigarette heater according to claim 2, wherein the heat insulation assembly further comprises an insulation tube disposed between the heating assembly and the anisotropic material layer; the insulation tube comprises an inner tube body and an outer tube body opposite each other along the radial direction, wherein a spacing is defined between the inner tube body and the outer tube body to form a first insulation cavity; the first insulation cavity is filled with a first powder insulation material; the anisotropic material layer is disposed on the outer surface of the outer tube body in an overlapping manner along the radial direction; wherein the first air medium layer is formed between the inner tube body and the heating body.

7. The cigarette heater according to claim 2, wherein the cigarette heater further comprises a hollow outer shell with an open end, an end cover base covering on the open end of the outer shell; the outer shell and the end cover base are matched to form an accommodating space, in which the heating assembly and the heat insulation assembly are disposed.

8. The cigarette heater according to claim 1, wherein the heat insulation assembly further comprises an insulation tube disposed between the heating assembly and the anisotropic material layer; the insulation tube comprises an inner tube body and an outer tube body opposite each other along the radial direction, wherein a spacing is defined between the inner tube body and the outer tube body to form a first insulation cavity; the first insulation cavity is filled with a first powder insulation material; the anisotropic material layer is disposed on the outer surface of the outer tube body in an overlapping manner along the radial direction; wherein the first air medium layer is formed between the inner tube body and the heating body.

9. The cigarette heater according to claim 8, wherein the first powder insulation material comprises at least one of aerogel powder, diatomite powder and zirconia powder.

10. The cigarette heater according to claim 9, wherein the first powder insulation material has a particle diameter of 500-1000 μm.

11. The cigarette heater according to claim 8, wherein the insulation tube further comprises a second insulation cavity defined outside the anisotropic material layer in an overlapping manner along the radial direction; the second insulation cavity is filled with a second powder insulation material.

12. The cigarette heater according to claim 11, wherein the first powder insulation material has a greater particle diameter than that of the second powder insulation material; the second powder insulation material has a particle diameter of 1 to 500-1000 μm.

13. The cigarette heater according to claim 8, wherein the heat insulation assembly further comprises an outer heat shield disposed outside the anisotropic material layer; the outer heat shield is configured for reducing the conduction of the heat from inside the heating cavity towards the periphery of the heating cavity along the radial direction.

14. The cigarette heater according to claim 13, wherein the outer heat shield has a heat radiation rate lower than 0.3.

15. The cigarette heater according to claim 13, wherein a spacing is defined between the insulation tube and the heating assembly along the radial direction to form a first air medium layer; and/or a spacing is defined between the anisotropic material layer and the outer heat shield along the radial direction to form a second air medium layer.

16. The cigarette heater according to claim 13, wherein the heating assembly comprises a bracket, an electromagnetic coil wound on the bracket, and an induction heating element electromagnetically coupled with the electromagnetic coil, the bracket defining an elongated heating cavity therein, which is configured for accommodating a cigarette.

17. The electric heating smoking apparatus, comprising a cigarette heater, and a power device configured for supplying power to the cigarette heater, wherein the cigarette heater is according to claim 8.

18. The cigarette heater according to claim 1, wherein the cigarette heater further comprises a hollow outer shell with an open end, an end cover base covering on the open end of the outer shell;

the outer shell and the end cover base are matched to form an accommodating space, in which the heating assembly and the heat insulation assembly are disposed.

19. An electric heating smoking apparatus, comprising a cigarette heater, and a power device configured for supplying power to the cigarette heater, wherein the cigarette heater comprising a heating assembly and a heat insulation assembly configured for insulating the heating assembly, the heating assembly comprising an elongated heating cavity configured for accommodating a cigarette and a heating body configured for heating the cigarette; wherein the heat insulation assembly comprises an anisotropic material layer sleeved outside the heating assembly, the anisotropic material layer having a lower thermal conductivity coefficient in the radial direction than in the axial direction, and the anisotropic material layer configured for reducing conduction of heat from inside the heating cavity towards periphery of the heating cavity along the radial direction; wherein a first air medium layer is formed between the heat insulation assembly and the heating body.

* * * * *